US005124285A

United States Patent [19]

Dislich

[11] Patent Number: 5,124,285

[45] Date of Patent: Jun. 23, 1992

[54] DOME FORMING SLIDING GATE FILLING COMPOSITION

[76] Inventor: Margrit Dislich, Wolfsberg 13, D-4330 Mülheim/Ruhr, Fed. Rep. of Germany

[21] Appl. No.: 595,096

[22] Filed: Oct. 10, 1990

[30] Foreign Application Priority Data

Nov. 16, 1989 [DE] Fed. Rep. of Germany ..... 3938050

[51] Int. Cl.[5] ..... C04B 35/12

[52] U.S. Cl. ..... 501/99; 222/600; 501/132

[58] Field of Search ..... 501/99, 132; 266/281, 266/271; 222/597, 600

[56] References Cited

U.S. PATENT DOCUMENTS

| | | | |
|---|---|---|---|
| 3,944,116 | 3/1976 | Danieli | 222/597 X |
| 4,222,782 | 9/1980 | Alliegro et al. | 501/132 X |
| 4,525,463 | 6/1985 | Dislich et al. | 501/99 |
| 4,928,931 | 5/1990 | Dislich et al. | 266/45 |

FOREIGN PATENT DOCUMENTS

| | | |
|---|---|---|
| 0018194 | 5/1980 | Japan . |
| 7139466 | 8/1982 | Japan . |

*Primary Examiner*—William R. Dixon, Jr.
*Assistant Examiner*—Lisa M. Schull
*Attorney, Agent, or Firm*—Marshall, O'Toole, Gerstein, Murray & Bicknell

[57] ABSTRACT

A dome forming sliding gate filling composition for teeming ladles comprises chrome ore sand, quartz sand, and fine grained carbon black as an additive which improves dome formation or increases pourability.

7 Claims, No Drawings

DOME FORMING SLIDING GATE FILLING COMPOSITION

The invention relates to a dome forming sliding gate filling composition that can be used to close off the pouring hole of a teeming ladle so as to protect the sliding gate, which composition consists essentially of chrome ore sand, quartz sand and a fine-grained additive which improves the formation of the dome and/or the pourability.

Teeming ladles for cast metal and/or cast steel generally have a tube shaped elongated pouring connection, the end of which can be closed off by a sliding gate. When the teeming ladle is filled with a new melt charge while the sliding gate is closed, the liquid metal would first of all flow into the pouring connection and the sliding gate, would cool there first of all and would block the sliding gate, preventing its further operation. For this reason the pouring connection above the closed sliding gate is first filled with a pourable material which when the sliding gate is closed keeps the melt away from the sliding gate, but which after opening the sliding gate pours out of the pouring connection and opens it for the flowing through of the melt. Dome forming sliding gate filling compositions have the property that in the area of contact with the melt they sinter or cake with the melt to form a sort of crust which prevents the melt from penetrating into the rest of the sliding gate filling composition. The aim is that in relation to the melt this crust forms a convex dome which ensures a better absorption of the hydrostatic pressure of the melt. For this reason an amount of the sliding gate filling composition is used so that above the pouring connection a slightly rounded heap of this material is present on the bottom of the teeming ladle.

For this reason sliding gate filling compositions have to meet two requirements: on the one hand they must form the sintered, dome shaped crust, and on the other hand underneath this crust they must remain so flowable that the part of the sliding gate filling composition that has not formed the crust will leave the pouring connection immediately after the sliding gate is opened, so that the dome shaped crust which now is no longer supported from underneath will collapse under the hydrostatic pressure of the melt and will release the pouring operation.

From DE-PS 32 14 168 and its counterpart U.S. Pat. No. 4,525,463 (Jun. 25, 1985) such a sliding gate filling composition is known which as dome forming additive contains 3–10% by weight of carbon in the form of electrode carbon, electrode coke and/or coking coal.

Especially when casting steel the presence of coal is a disadvantage, since as a result thereof a carburizing of the steel melt may take place which exceeds the permissible limits. Attempts were therefore made to achieve the dome formation by other additives. Relatively satisfactory results were obtained with a dome forming sliding gate filling composition as described in DE-PS 34 19 306 and its counterpart U.S. Pat. No. 4,928,931 (May 29, 1990). This sliding gate filling composition contains as fine-grained additive iron oxide but no coal. However, this iron oxide containing sliding gate filling composition cannot be used in all cases, as depending on the nature of the melt care must be taken that it is not contaminated by certain substances.

It is the object of the invention to provide a dome forming sliding gate filling composition which ensures a good dome formation, for the rest remains highly pourable, does not produce an appreciable carburization of the melt, but also does not contain separately added iron oxide powder.

Thus, according to the invention there is provided a dome forming sliding gate filling composition for teeming ladles, which comprises chrome ore sane, quartz sand and a fine-grained additive which improves the formation of the dome or increases the pourability, characterized in that the additive is a carbon black.

Preferably the composition contains 0.1–1.9% carbon black, 50–80% chrome ore sand, the balance being quartz sand.

Surprisingly it was found that the desired requirements are met by a very specific, carbon containing material, i.e. carbon black, although because of the risk of the carburizing of a steel melt the use of carbon should in fact be avoided.

It was found on the one hand that when carbon black is used it suffices to add a quantity is significantly smaller than the quantity of carbon as indicated for example in the U.S. Pat. No. 4,525,463. Apart from the fact that only small quantities need be added, on contact with the liquid steel the carbon black seems to gasify, and the resultant gas isolates the rest of the sliding gate filling composition from the melt, so that no further carbon from the rest of the sliding gate filling composition gets into the melt, as a result of which notwithstanding the use of a carbon containing material the carburizing effect remains extremely small. Because of this unexpected property the sliding gate filling composition according to the invention is also particularly suitable for long treatment times.

In particular a flame carbon black has proved suitable as an additive. This preferably is a flame carbon black which has ashing residues of approximately 0.05% and a BET surface of approximately 20 $m^2/g$.

As expediently a chrome ore sand with a pH-value of between 7 and 9 is used, the carbon black should preferably have a pH-value of approximately 7.

It must be pointed out that all percentage indications herein are percentages by weight.

The basic composition of the sliding gate filling composition consists of 50 to 80% chrome ore sand, the balance being quartz sand and unavoidable impurities. The exact ratio of the components of the sliding gate filling composition must be determined by tests for each teeming ladle as well as for each casting task. The reduction of the chrome ore must be adequate but not too far-reaching, and the sintering should take place only in the area of contact between the sliding gate filling composition and the melt.

The chrome ore sand portion consists preferably of 44–52% chrome trioxide ($Cr_2O_3$) with a particle size of up to 1 mm.

In a preferred embodiment of the chrome ore sand has the following particle size distribution:

| | |
|---|---|
| 0.5–1 mm | approx. 10% |
| 0.25–0.5 mm | approx. 50–65% |
| 0.125–0.25 mm | approx. 26–41% |
| <0.125 mm | max. 3–11% |

Also the quartz sand content is preferably chosen very pure; more than 98% of it is preferably $SiO_3$ and with a particle size of 0.5–1.5 mm, in the following particle size distribution:

| | |
|---|---|
| 1.25–1.5 mm | approx. 2.0% |
| 1.0–1.25 mm | approx. 41.1% |
| 0.5–1.0 mm | approx. 55.8% |
| 0.25–0.5 mm | approx. 0.9% |
| <0.25 mm | approx. 0.2% |

In the case of long or very long treatment times (e.g. crucible furnaces, vacuum plants), by using the sliding gate filling composition according to the invention a practically 100% opening rate can be achieved.

A further advantage of the present invention lies in the fact that because of its great fineness the selected carbon black encases all the grains of the mixture, so that in this way the pourability can be increased considerably.

Furthermore, when in contact with the liquid steel the carbon black gasifies, and the resultant gas in this manner isolates the rest of the sliding gate filling composition from contact with the melt.

In the following, with reference to Table 1 the improved pourability of the sliding gate filling compositions according to the invention will be demonstrated.

In this A denotes a conventional sliding gate filling composition which contains carburizing material made from tar or anthracite with a particle size of 1–4 mm.

The sliding gate filling composition B according to the invention contains carbon black which has a pH-value of 7, ashing residues of 0.05 and a BET surface ($m^2/g$) of 20.

Table 1 clearly shows the improved pourability of the sliding gate filling composition according to the invention.

TABLE 1

| Opening angle | Weighed-in quantity (g) | | Time (sec) | | Pourability (g/sec) | |
|---|---|---|---|---|---|---|
| % | A | B | A | B | A | B |
| 35 | 2170 | 2140 | 32 | 19 | 67.8 | 112.6 |

TABLE 1-continued

| Opening angle | Weighed-in quantity (g) | | Time (sec) | | Pourability (g/sec) | |
|---|---|---|---|---|---|---|
| % | A | B | A | B | A | B |
| 40 | 2115 | 2105 | 20 | 19 | 105.8 | 110.8 |
| 50 | 2120 | 2190 | 14 | 13 | 151.4 | 160.5 |

I claim:

1. Dome forming sliding gate filling composition for teeming ladles, which comprises chrome ore sand, quartz sand and a fine-grained additive which improves the formation of the dome or increases the pourability, characterized in that the additive is a carbon black.

2. Sliding gate filling composition according to claim 1, characterized in that it contains 0.1–1.9 weight % carbon black, and 50–80 weight % chrome ore sand, the balance being quartz sand.

3. Sliding gate filling composition according to claim 1, characterized in that the carbon black is a flame carbon black.

4. Sliding gate filling composition according to claim 3, characterized in that the carbon black has a pH-value of approximately 7, ashing residues of approximately 0.05% and a BET surface of approximately 20 $m^2/g$.

5. Sliding gate composition according to claim 1, characterized in that the chrome ore sand consists of 44–52% $Cr_2O_3$ and has a particle size of up to 1 mm.

6. Sliding gate filling composition according to claim 1, characterized in that the chrome ore sand has the following particle size distribution:
1.0–0.5 mm approx. 10 weight %
0.5–0.25 mm approx. 50–65 weight %
0.25–0.125 mm approx. 26–41 weight %
<0.125 mm approx. 3–11 weight %.

7. Sliding gate filling composition according to claim 1, characterized in that the quartz sand content consists of more than 98 weight % $SiO_2$ and has a particle size of 0.5–1.5 mm, in the following particle size distribution:
1.25–1.5 mm approx. 2.0 weight %
1.0–1.25 mm approx. 41.1 weight %
0.5–1.0 mm approx. 55.8 weight %
0.25–0.5 mm approx. 0.9 weight %
<0.25 mm approx. 0.2 weight %.

* * * * *